United States Patent [19]

Strohmeyer, Jr.

[11] Patent Number: 4,567,674

[45] Date of Patent: Feb. 4, 1986

[54] UNFIRED DRYING AND SORTING APPARATUS FOR PREPARATION OF SOLID FUEL AND OTHER SOLID MATERIAL

[75] Inventor: Charles Strohmeyer, Jr., Gladwyne, Pa.

[73] Assignee: Electrodyne Research Corp., Gladwyne, Pa.

[21] Appl. No.: 739,168

[22] Filed: May 30, 1985

[51] Int. Cl.[4] ..... F26B 17/00

[52] U.S. Cl. ..... 34/57 A; 110/218; 110/224

[58] Field of Search ..... 110/218, 224, 245, 263, 110/347; 34/10, 57 R, 57 A; 122/4 D

[56] References Cited

U.S. PATENT DOCUMENTS

| | | | |
|---|---|---|---|
| 3,884,193 | 5/1975 | Bryers | 122/4 D |
| 4,116,005 | 9/1978 | Willyoung | 122/4 D |
| 4,153,427 | 5/1979 | Bissett et al. | 34/57 A X |
| 4,251,207 | 2/1981 | Beck et al. | 34/57 A X |
| 4,311,103 | 1/1982 | Hirose | 110/224 X |
| 4,311,670 | 1/1982 | Nieminer et al. | 34/10 |
| 4,324,544 | 4/1982 | Blake | 110/245 |
| 4,325,327 | 4/1982 | Kantesaria et al. | 110/245 |

*Primary Examiner*—Edward G. Favors
*Attorney, Agent, or Firm*—William J. Ruano

[57] ABSTRACT

The invention comprises an unfired fluidized bed dryer and sorter. Pressurized fluidizing air is preheated passing through steam heat exchangers. Bed outlet air/vapor temperature is held in a range of 100 F. to 150 F. Smaller/low density solids are removed from the top of the bed and larger/heavier solids are removed from the bottom of the bed after some retention in the bed. Feedstock is fed continuously to the bed. The exhaust air/water vapor from the bed is postheated at least 20 F. before passage through a bag house by addition of steam heated air to the air/vapor stream exhausting from the bed. Moisture content of the effluent solid materials from the bed is controlled by mass flow rate of the fluidizing air and rate of steam flow to the bed air heater.

8 Claims, 2 Drawing Figures

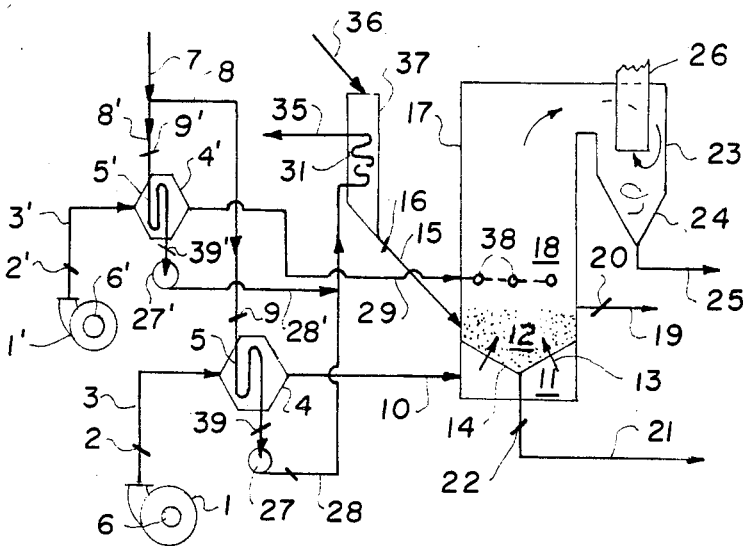
Fig. 2
Fig. 1
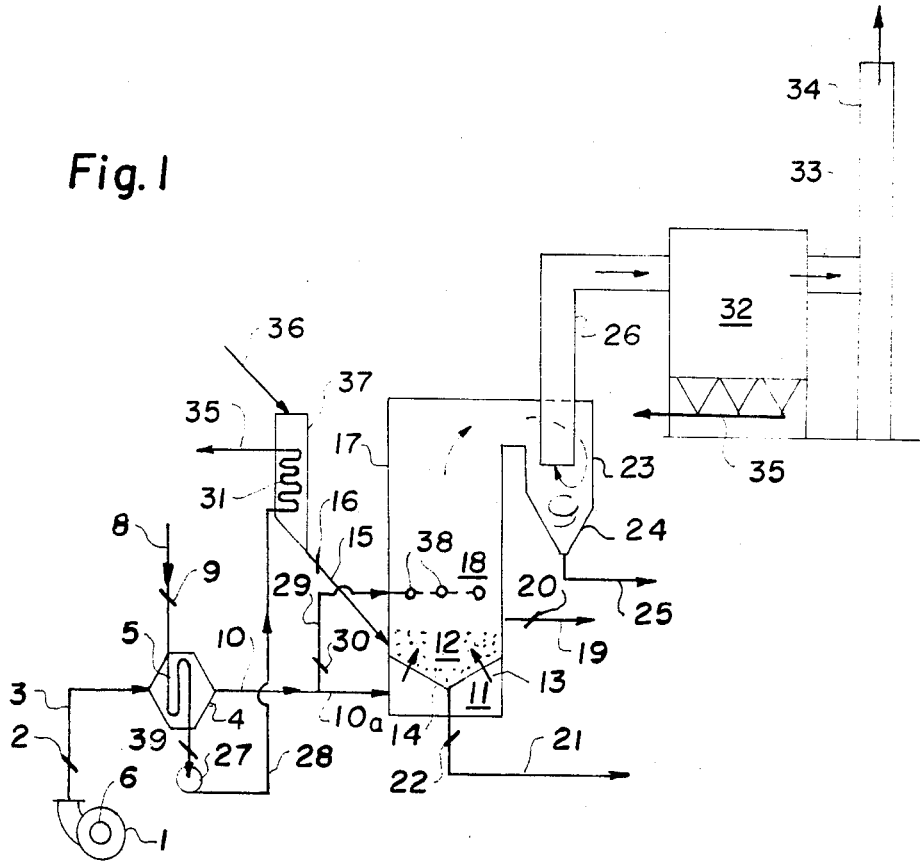

UNFIRED DRYING AND SORTING APPARATUS FOR PREPARATION OF SOLID FUEL AND OTHER SOLID MATERIAL

This invention is an improvement over U.S. patent application Ser. No. 06/464,062 filed 02/03/83 now U.S. Pat. No. 4,449,483 and is a variation thereupon.

This invention relates to improved means for utilization of solid fuels and other materials where separation of foreign matter, sizing or moisture content of the material has an influence upon the effective utilization of the material. The sorting, sizing and drying apparatus employs fluidized bed principles using air/gas as the fluidizing and drying medium.

The denser/larger particles settle to the lower portion of the fluidized bed and the less dense/smaller particles rise to the upper portion of the bed. Unsaturated air/gas passing through the bed removes surface moisture through evaporation.

In the present invention the fluidized bed is of the unfired type and is used for sorting purposes to separate the more dense particles from the less dense particles or to classify the solid material particulate by size. Unsaturated air/gas is admitted to the bed in a distributed manner after preheating to supply the required heat for the processing action in the fluidized bed. The air/gas stream is then passed up vertically through the bed containing the solid materials, heating and fluidizing them along with vaporizing surface moisture. When in a fluidized state, the smaller/lower density particles rise to the top of the bed. At least a portion of the surface moisture on the particles is evaporated.

The quantity and temperature of the air/gas flow is sufficient to retain the evaporated surface moisture in the vapor phase. Feedstock of solid materials is added at an intermediate location of the bed. The larger/more dense fluidized particles are removed from bottom location/s of the bed. The smaller/less dense fluidized particles are removed from top location/s of the bed. The temperature and vapor holding capacity of the air/gas leaving the bed is substantially higher than the ambient conditions. The air/gas is again heated by indirect means downstream of the bed for reducing relative humidity of the air/gas substantially below saturation prior to passage through a bag house for fine particle collection, after which the air/gas along with the superheated water vapor is discharged to atmosphere. An optional mechanical solids separator can be installed between the bed and bag house.

The present invention relates to a useful variation for superheating the vapor leaving the bed before entry to the bag house or optional mechanical solids separator. The superheating means can also be employed to carry fines from the bed to downstream collection means.

For the apparatus and systems described herein, a specific object of this invention is to provide a means for separation of more dense/larger solid material particulate from less dense/smaller solid material particulate utilizing unfired fluidized bed principles.

A further object is to dry said solid material during the separation process.

A still further object is to provide a means to separate and collect solid particles entrained in the air/gas stream used for fluidizing the bed at a location downstream of the bed.

A still further object is to preheat the air/gas used for fluidizing the bed sufficiently to provide the required heat for the in-bed separation and drying process.

A still further object is to postheat the fluidizing air/gas leaving the fluidized bed before passage through a fabric filter type bag house for fine particle removal and subsequent discharge to atmosphere through a stack, and in a manner to minimize erosion of the postheating means.

A still further object is to utilize the waste heat from the preheating and/or postheating means to preheat the solid material prior to being fed to the unfired fluidized bed.

The invention will be described in detail with reference to the accompanying drawings wherein:

FIG. 1 is a sectional diagramatic arrangement of the unfired drying and sorting apparatus wherein postheating is accomplished through use of the same heat transfer apparatus employed for air/gas preheating.

FIG. 2 is a partial sectional diagramatic arrangement of the unfired drying and sorting apparatus illustrating the differences wherein postheating is accomplished through use of a similar but parallel heat transfer apparatus employed for air/gas preheating.

On FIG. 1 fluidizing air fan 1 pressurizes atmospheric air at ambient temperature to approximately 58" Wg which then discharges through isolation damper 2 and conduit 3 to air plenum 4 in which steam coil air heater 5 is located. Inlet vanes 6 at fan 1 control air supply to fan 1 and rate of air flow to conduit 3. Damper 2 is optional.

Process steam is supplied through conduit 8 to steam coil 5. Throttling means 9 regulates steam flow rate to coil 5. Steam coil 5 heats the effluent air in conduit 10 sufficiently to satisfy the process requirements of fluidized bed 12. Ducts 10 and **10*a* discharge to plenum 11. Heated air in plenum 11 flows through ports 13 in floor 14 to and through bed 12. Ports 13 are uniformly distributed over floor 14**.

A feedstock of solid particles flows into bed 12 through conduit 15 and flow control means 16 at an intermediate location.

Bed 12 is contained in vessel chamber 17 incorporating a plenum 18 over bed 12. Less dense/smaller solid particles are removed through conduit 19 and flow control means 20. More dense/larger solid particles are removed through conduit 21 and flow control means 22.

Plenum 18 discharges to cyclone separator 23 where fine particles are collected in hopper 24 and withdrawn through conduit 25. The air/gas ladden with water vapor is withdrawn through conduit 26 for discharge to bag house 32.

To prevent fine particulate carried over from the bed with the air/gas stream from clogging cyclone separator 23 or bag house 32 as a consequence of a saturated water vapor environment, the relative humidity of the air/gas stream downstream of bed 12 is reduced a substantial amount below the saturation level.

In the case of U.S. Pat. No. 4,449,483, hot gas through conduit 10 is controlled by regulator 10R to maintain temperature in plenum 11 between 300° and 325° F. in the case where separator 12 effluent passes to bag house 14, Col. 4, lines 11 through 14 inclusive. Also, "An operating objective is to hold gas temperature at point 9 above bed 4 at a level of 200° F.", Col 4, lines 3 and 4. In such case, bed air/gas postheating was from the bed air/gas preheating source.

In the present invention, on FIG. 1, hot air/gas from duct 10 also passes through duct 29, through flow rate control means 30, to and through ports 38 which are spaced uniformly around the periphery of vessel chamber 17. Inside vessel chamber 17, the hot air/gas from ports 38 mixes with the air/gas stream exiting from bed 12 raising the combined air/gas temperature substantially. This in turn reduces the relative humidity of the air/gas stream passing through the cyclone separator 23 and bag house 32 preventing sticking of the fine solids as they pass through separator 23 and bag house 32.

Bag house 32 is of the fabric filter type. Fines are separated from the gas stream so that the effluent in duct 33 and stack 34 conforms to environmental standards as it discharges to atmosphere. Other means of collection could be substituted for the bag house as an electrostatic precipitator.

Dust collected in bag house 32 is removed through conduit system 35.

For the case illustrated, a mixture of coal and heavier inert material is fed through conduit 15 to bed 12. The less dense coal is removed through conduit 19. The inert material including slate is removed through conduit 21.

Other solid removal points may be located at various elevations between points 19 and 21.

Approximately 4136 lb of ambient air are required for fluidizing, heating and vapor transit per ton of feedstock processed to remove a surface moisture content of 12 percent.

Ambient air is heated to approximately 370 F., passing through steam coils 5. Process steam to the coils is 200 psig or greater. Pressure drop through the bed 12 is in a range of 40" Wg. Air/gas velocity through the bed 12 is in the range of 8 ft./sec.

The heat in the air/gas entering the bed 12 through ports 13 should be sufficient to maintain an air/gas temperature of about 120 F. at the bed 12 outlet. A range of from 100 F. to 150 F. is considered optimal.

The hot air/gas entering plenum 18 through ports 38 (approxamately 370 F.) mixes with the air/gas and water vapor exiting from bed 12 raising the temperature of the combined mixture. A rise of 40 F. is contemplated as being satisfactory for post heating. This reduces the relative humidity of the air/gas stream leaving the bed from near 100 percent to about 25 percent as the air/gas enters baghouse 32. This assures passage of the water vapor through baghouse 32 leaving the solid particulate residue on the bags in a dry state for removal through conduit 35.

An air/gas temperature increase at the bed 12 outlet in a range of from 20 F. to 112 F. is considered optimal. In this regard, the 20 F. low limit is truly significant for mechanical feasibility. The high limit of 112 F. is for economic reasons. Obviously, Air/gas temperature rise could exceed 112 F.

Approximately 906 lb. of ambient air after pressurization in fan 1 and heating in steam coil 5 to 370 F. and injected through ports 38 are required for a postheating temperature rise of 40 F. in plenum 18.

In the case illustrated, the moist coal is preheated in hopper 37. Coal is fed by chute 36 to hopper 37 so as to keep the level of the solid material in the hopper above heating surface 31. As stated above, solid material from hopper 37 flows through conduit 15 to bed 12. Flow rate controller 16 adjusts the feed rate to bed 12 to suit the needs of the process. There is continuous feed to and removal from bed 12.

As steam from conduit 8 is condensed in steam coil 5, drain controller 39 passes condensate to drain pump 27. Pump 27 discharges the hot condensate through conduit 28 to heating surface 31 submerged in the solid material passing through hopper 37. The drains passing through heating coils 31 are cooled before passing out through conduit 35 for return to the steam supply system furnishing steam to coils 5.

The hopper 37 drain cooler 31 substantially reduces the amount of hot air required for drying in bed 12. There is adaquate heat available in the steam coil 5 drains to heat the solids feedstock in hopper 37 to the saturated vapor temperature at 120 F. It is not the intent to vaporize the moisture in the feedstock in hopper 37.

Air/gas injected through ports 38 to plenum 18 can be located over bed 12 in a manner to increase air/gas velocity, thereby causing entrainment of some of the fines in the air/gas passing to cyclone separator 23. The material collected in separator 23 will be courser that that collected in bag house 32. Thus, a material sizing is accomplished which produces beneficial results. The material from separator 23 is uniform and can be sold as a separate product for various types of usage. The material collected in the bag house can be a substitute for lamp black, having approximate characteristics or requiring minimal additional processing to reach commercial standards.

Hot air drawn from conduit 10 of FIG. 1 is at a pressure much higher than is required for injection through ports 38 to plenum 18 and must be throttled by flow control means 30 responsive to downstream temperature in plenum 18 (not shown). Also, the amount of flow through conduit 29 then becomes a function of temperature of air/gas exiting from steam coils 5. The arrangement shown on FIG. 2 permits greater flexibility by separation of the hot air supplies for bed 12 and post heating ports 38.

Referring to FIG. 2, the basic difference from FIG. 1 is as follows:

Conduit 10 supplies hot air to plenum 11 under bed 12 only. A separate hot air supply is furnished for postheating through ports 38. Separate fan 1' has a much lower discharge head, as 23" Wg, as pressure drop through bed 12 need not be considered. Steam coil 5' can be sized for a wide range of conditions. Where it is desired to increase air flow through ports 38 to increase skimming of fines over bed 12, temperature of the air/gas from coils 5' can be lowered to maintain postheating in plenum 18 to a preset level as 40 F. Ports 38 can be located directly over bed 12 and be equipped with nozzles which tip up or down to regulate the skimming effect as bed height varies.

Duplicate items are fan 1', isolation damper 2', inlet control vanes 6', transport duct 3', air plenum 4', steam supply conduit 8', steam coil air/gas heater 5'. Conduit 29 connects to the outlet of air plenum 4'. Drain regulator 39' controls condensate flow to drain pump 27' which discharges through conduit 28' to drain cooler 31. Air/gas flow to ports 38 is regulated by inlet vane 6' associated with fan 1'. Postheating in plenum 18 is controlled by steam flow controller 9' in response to downstream air/gas temperature in plenum 18. The rate of heat transfer across steam coils 5' is a function of steam flow to coils 5' and steam pressure within coils 5'. Drain controller 39' limits flow to pump 27' passing condensate only.

The parallel hot air supply systems permit each system to function individually. One system supplies preheating hot air/gas to plenum 11. The other system supplies hot air/gas to ports 38 for post heating and optional skimming of fines from the top of bed 12.

The sorting and drying process is accomplished at low working temperatures. Stack thermal losses are minimized. Heavy density inert solids can be removed through conduit 21 and less dense active fuel removed through conduit 19. Where various size partilcles of the same material are fed through conduit 15 as a feedstock on a continuing basis, the larger sized particles are remove through conduit 21 and smaller sized particles are removed through conduit 19. In between sized particles can be removed from additional points between points 19 and 21.

The degree of drying can be controlled by the temperature and mass flow rate of the air/gas supply in conduit 10 to bed 12. Air/gas mass flow rates will vary plus and minus 50 percent to suit specific characteristics of the material processed. The same applies to the air/-gas supply temperature to bed 12. The steam pressure need only be adaquate to realize the required heat transfer rates. Steam coil 5 is governing. Density of the solids processed will influence the depth of the bed, pressure drop through the bed, and air/gas velocity through the bed which can be tolerated. The outlet air/gas temperature of bed 12 ia a measure of the vapor content leaving the bed. The temperature increase at the outlet of bed 12 before the air/gas enters cyclone separator 23 assures non-clogging performance through the separator and bag house 32. Injection of hot air/gas through ports 38 can be used to control concentrations of fine solids at the top of bed 12.

Thus, it will be seen that I have provided an efficient embodiment of my invention whereby means are provided for separation of more dense/larger solid particles from less dense/smaller solid particles utilizing unfired fluidized bed principles, solid material is dried during the separation process, solid particles entrained in the air/gas stream used for fluidizing purposes are collected downstream of the bed, the air/gas is preheated before admission to the bed for conveyance of process heat to the bed, post heating downstream of the bed before passage of the air/gas through a bag house or equivalent permits free passage of the water vapor to atmosphere and separation of the solid particles without clogging, means are provided to control the concentration of fine solids at the bed outlet, and preheating of the feedstock fed to the bed is accomplished utilizing waste heat from the air/gas preheating process.

While I have illustrated and described various embodiments of my invention, these are by way of illustration only and various changes and modifications may be made within the contemplation of my invention and within the scope of the following claims:

I claim:

1. An unfired drying and sorting apparatus for preparation of solid fuel and other material incorporating:

a fluidized bed consisting of a mixture of moisture bearing solid particles of fuel and other material suspended in a vertical chamber and supported by a floor;

ports in said floor for recieving a continuous supply of pressurized and heated air for fluidizing said bed;

means for continuously supplying unsaturated and pressurized air to said ports at a variable and preselected flow rate; first steam coil air heater for heating said pressurized air upstream of said ports;

means for selective control of steam supply to said first steam coil air heater;

means for continuously feeding said moisture bearing solid particles to said bed;

means for continuously removing said solid particles from said bed after retention in said bed for some period of time, retention providing time for drying of said solid particles;

means for continuously removing air and vapor generated from said moisture at the outlet of said verticle chamber;

first regulatory means including said means for air supply to said ports at a predetermined flow rate and said means for selective control of steam supply to said first steam coil air heater adapted for maintaining said air and vapor temperature exhausting from said bed in a range of from 100 F. to 150 F. to regulate the degree of moisture removal from said fuel and other material for maintaining the residual moisture in said fuel and other material below a predetermined value;

a bag house filter type or equivalent solids collector connected to said vertical chamber outlet means and including second ports adapted for supplying a portion of said heated pressurized air to said air and vapor stream exhausting from said bed before entry to said collector, and second regulatory means for control of said portion of said heated pressurized air through said second ports and adapted for maintaining said portion after mixing with said air and vapor stream exhausting from said bed at a predetermined value at least 20 F. above said air and vapor saturated temperature exhausting from said bed, post-heating said air and vapor stream exhausting from said bed superheating said air and vapor stream and enabling free passage of said air and vapor through said bag house without fouling as a result of wetted solid formation on said bag house collector filters.

2. An apparatus as recited in claim 1 and wherein:

said means for continuously removing said solid particles from said bed comprising a first means for removal of a more dense/larger sized portion of said solid particles from a lower portion of said bed, and a second means for removal of a less dense/smaller sized portion of said solid particles from a top/intermediate portion of said bed.

3. An apparatus as recited in claim 1 and including:

means connected to said vertical chamber air and vapor removal means for separating particles entrained in said air and vapor exiting from said bed by centrifugal action in said air and vapor gas bath upstream of said bag house or equivalent collector.

4. An apparatus as recited in claim 1 and wherein:

said means for continuously supplying unsaturated and pressurized heated air are individual for said ports in said bed floor and for said second ports, said individual air supply means including separate steam air heater and means for selective control of steam supply to said separate steam air heater, said air supply flow rate and said selective control of steam supply for said individual air supply to said second ports maintaining said air and vapor superheat at said predetermined value.

5. An apparatus as recited in claim 1 and including:

a heat exchange apparatus for heat transfer between the condensate drains from the steam air heater and said means for continuously feeding said moisture bearing solid particles to said bed, preheating said solid particles.

6. An apparatus as recited in claim 4 and including:

a heat exchange apparatus for heat transfer between the condensate drains from any individual steam air heater and said means for continuously feeding said moisture bearing solid particles to said bed, preheating said solid particles.

7. An apparatus as recited in claim 4 and wherein:

said second ports are disposed above said bed in a uniform distributed horizontal pattern around the wall of said vertical chamber in a manner to skim fine solids from the top level of said bed.

8. An apparatus as recited in claim 7 and wherein;

said second ports can be tilted slightly up or slightly down to control said skimming effect over said bed upper level.

* * * * *